US005789687A

United States Patent [19]

Johnson

[11] Patent Number: 5,789,687

[45] Date of Patent: Aug. 4, 1998

[54] MUSICAL INSTRUMENT SUPPORT

[76] Inventor: Wallace W. Johnson, 307 Monroe St., Iowa City, Iowa 52246-1615

[21] Appl. No.: 800,299

[22] Filed: Feb. 13, 1997

[51] Int. Cl.[6] ..... G10D 7/10

[52] U.S. Cl. ..... 84/387 A

[58] Field of Search ..... 84/387 A; 224/910; 248/125.1; 297/186, 217.1, 188.2, 188.4

[56] References Cited

U.S. PATENT DOCUMENTS

| | | | |
|---|---|---|---|
| 2,575,540 | 11/1951 | Wenger | 374/192 |
| 3,024,690 | 3/1962 | Sanstead | 84/387 A |
| 3,193,325 | 7/1965 | Wenger | 297/186 |
| 3,259,428 | 7/1966 | Wenger et al. | 297/186 |
| 3,811,357 | 5/1974 | Stewart | 84/327 |
| 4,065,994 | 1/1978 | Streit | 84/453 |
| 4,067,527 | 1/1978 | Streit | 248/123.2 |
| 4,441,683 | 4/1984 | Mayne | 248/558 |
| 5,161,766 | 11/1992 | Arima | 248/447 |

*Primary Examiner*—William M. Shoop, Jr.
*Assistant Examiner*—Shih-yung Hsieh
*Attorney, Agent, or Firm*—Richard C. Litman

[57] ABSTRACT

A chair-borne musical instrument support that is both adjustable and portable. The musical instrument support includes a seat portion having an adjustably attached support arm with an instrument rest attached to the top thereof. The musician places the seat portion of the device on the seat of a chair, and then sits on the seat portion. The support arm and instrument rest extend upward near the front edge of the chair and between the legs of the musician. The weight of the musician sitting on the chair holds the device in place. Alternatively, the musical instrument support may be held in place on a chair by adjustable straps. The base of the tuba is then placed upon the instrument rest which is covered with a non-abrasive, non-skid surface. The support arm and instrument rest may be adjusted vertically up or down to a comfortable height. The instrument then rests in the same position as if it were being held on the musician's lap, but now it does not have to be borne by the musician's legs. The musical instrument support is not permanently attached to the chair; therefore, the support may be easily removed and carried with the musician or stored for later use. Several embodiments of the present invention are contemplated which are designed to be used by different size musicians and with different types of instruments.

4 Claims, 4 Drawing Sheets

MUSICAL INSTRUMENT SUPPORT

BACKGROUND OF THE INVENTION

1. Field of the Invention

The present invention relates to a chair-borne musical instrument support. More specifically, the invention is a portable and adjustable stand for supporting tubas or other musical instruments while seated in a chair.

2. Description of Prior Art

A concert style tuba is designed to be played with the lower end of the tuba resting on the musician's thighs, while the upper end is balanced upright by the musician's arms and hands. Many musicians are able to successfully balance the instrument in the proper manner upon their lap, but this can be tiring task since it is generally a constant struggle. The instrument has the tendency to slide down the musician's thigh as the instrument is being played and, therefore, it may need nearly continuous readjustment. The instrument can also be fairly heavy and, therefore, create uncomfortable pressure on the musician's thighs.

While many musicians are able to play the instrument in the recommended manner, holding this rather large and awkward instrument can be almost impossible for some musicians, and it can be tedious and difficult for others. Beginning players, young children, and senior citizens may have a tremendous amount of difficulty stabilizing the instrument upon their lap during playing. Individuals with certain handicaps may find that the task of supporting the instrument upon their lap tedious and tiring, or even impossible.

In an effort to make playing the tuba more comfortable, many musicians will slide back in their chairs and rest the tuba on the front corner of their seat between their legs. This is especially true when the musician spends a long time playing the instrument. While this makeshift solution does relieve the pressure on the musician's lap, it results in an awkward sitting position for the musician.

A chair-borne device is needed which is capable of acting as a musical instrument support for a tuba or other musical instrument. The musical instrument support should be portable and adjustable. The musical instrument support should provide the musician with the sense that the instrument is being balanced on a musician's lap, yet at the same time allow the musician to be more comfortable and to more easily manage the instrument. The musical instrument support should not compromise the acoustic characteristics of the instrument, nor should it scratch the instrument. The musical instrument support should accommodate use by a range of musicians of varying body size, as well as accommodate a variety of different musical instruments.

The following patents describe musical instrument supports which are either integrated into the design of a chair or are bulky, thereby rendering these devices difficult to transport. U.S. Pat. No. 2,575,540, issued on Nov. 20, 1951, to Harry J. Wenger describes a combined seat and support for large musical instruments such as a sousaphone. U.S. Pat. No. 3,193,325, issued on Jul. 6, 1965, also to Harry J. Wenger describes an adjustable combination seat and support for large musical instruments such as a sousaphone. U.S. Pat. No. 3,259,428, issued on Jul. 5, 1966, to Harry J. Wenger et al., describes an adjustable combination seat and support for a tuba. U.S. Pat. No. 4,065,994, issued on Jan. 3, 1978, and U.S. Pat. No. 4,067,527, issued on Jan. 10, 1978, both issued to James L. Streit describe an adjustable free standing structure for supporting a musical instrument.

U.S. Pat. No. 3,024,690, issued on Mar. 13, 1962, to John L. Sanstead describes a sousaphone support including a leg having an adjustable length, the lower end of which is adapted to be supported in a number of selected positions, and the upper end of which is adapted to be secured to the instrument. The patent to Sanstead describes an instrument support which when used while seated requires that the musician not only balance the instrument on the support, but also balance the support itself.

U.S. Pat. No. 3,811,357, issued on May 21, 1974, to Merlin D. Stewart describes a tuba supporting rod that is attached to the tuba and serves as an adjustable stand, supporting the tuba from the surface of the seat. The patent to Stewart describes a musical instrument support which is fixedly attached to the instrument, thereby requiring modification of the instrument. The patent to Stewart does not describe a device which may be used with any suitable musical instrument without modification of the instrument.

U.S. Pat. No. 4,441,683, issued on Apr. 10, 1984, to Richard G. Mayne describes a storage holder for cumbersome instruments, such as tubas, that provides support in either a horizontal or a vertical orientation. The patent to Mayne describes a device for use as a means for storing the instrument and fails to describe an adjustable device for supporting a musical instrument while the instrument is being played.

None of the above inventions and patents, taken either singularly or in combination, is seen to describe the instant invention as claimed. Thus a musical instrument support solving the aforementioned problems is desired.

SUMMARY OF THE INVENTION

The present invention is a chair-borne musical instrument support that is both adjustable and portable. The musical instrument support includes a seat portion from which a height-adjustabe support arm depends, the upper end of the support arm terminating with an instrument rest. The seat portion rests on the seat of a chair; the musician then sits on the seat portion, to act in part as a counterweight to the weight of the instrument to be placed on the instrument rest, and, holding the device itself firmly in place from the weight of the musician. Alternatively, the musical instrument support may be held in place on a chair by adjustable straps.

The support arm and instrument rest is positioned to extend upward between the legs of the musician from the seat portion proximate to the front edge of the chair. The base of a large musical instrument, e.g. a tuba, is then placed upon the instrument rest, covered with a non-skid, non-abrasive surface material. The support arm and instrument rest is vertically adjustable to allow the musician to choose a comfortable height for playing the instrument.

The instrument thus is allowed to rest in the same position as if it were being held on the musician's lap without being borne by the musician's legs. The musical instrument support is not permanently attached to the chair, therefore the support may be easily removed and carried with the musician or stored for later use. Several embodiments of the present invention are contemplated which are designed to be used by different size musicians and with different types of instruments.

Accordingly, it is a principal object of the invention to provide a chair-borne device for supporting a large musical instrument.

It is another object of the invention to provide a musical instrument support that is portable and is capable of being used with any conventional chair.

It is a further object of the invention to provide a musical instrument support that is adjustable to accommodate different size musicians and different size instruments.

Still another object of the invention is to provide a musical instrument support which when in use by a musician simulates the feel of balancing an instrument on the musician's lap, yet allows the musician to be comfortable and to easily manage the instrument.

It is another object of the invention to provide a musical instrument support which does not compromise the acoustic characteristics of the instrument.

It is a further object of the invention to provide a musical instrument support constructed or surfaced so as to minimize the risk of scratching the surface of the instrument which is being supported.

Still another object of the invention is to provide a musical instrument support having means for supporting varying sizes and shapes of instruments.

It is an object of the invention to provide improved elements and arrangements thereof in a musical instrument support for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
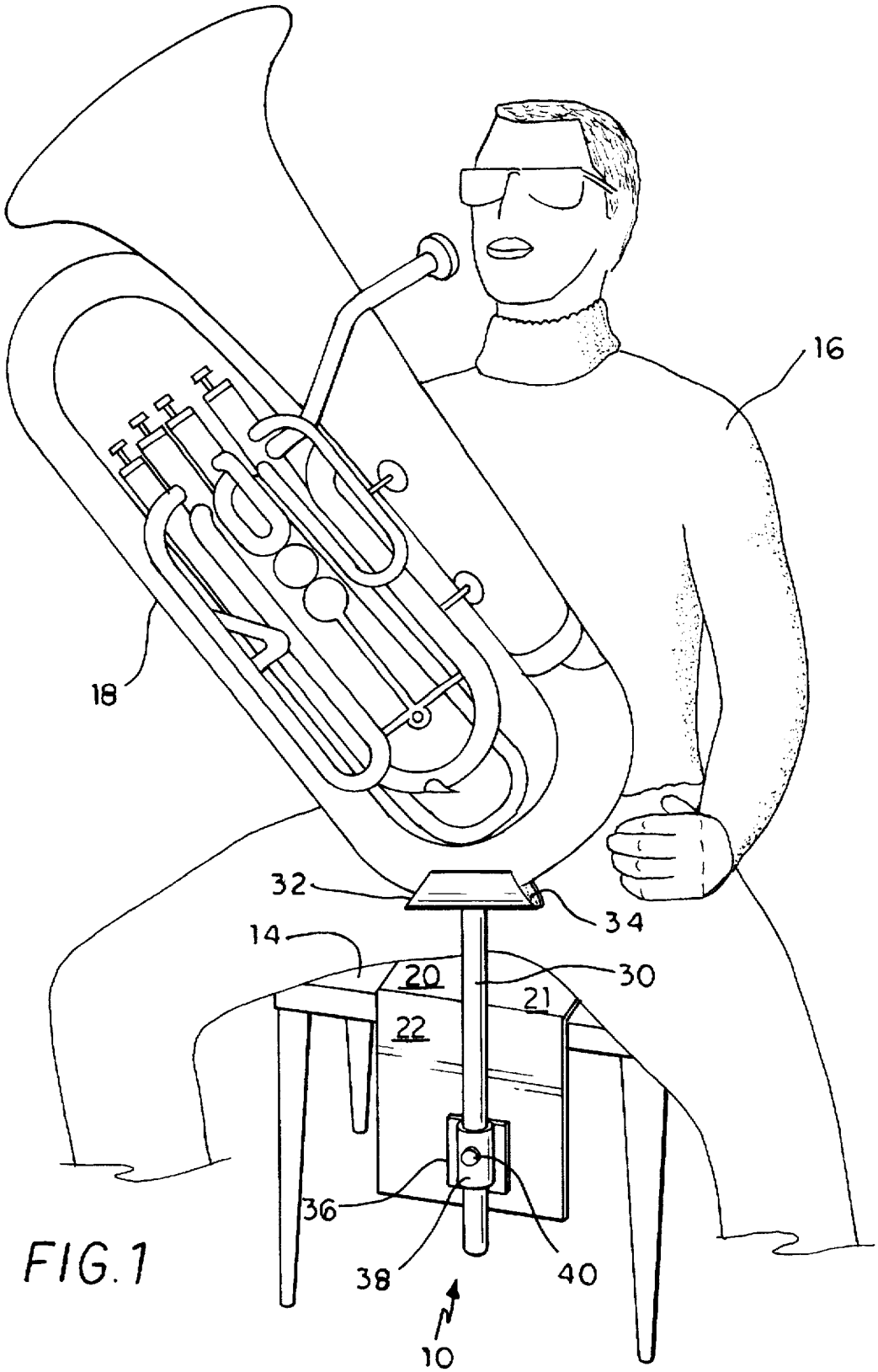
FIG. 1 is an environmental, perspective view of a musical instrument support according to the first embodiment of the present invention.

Referring to FIG. 1, the present invention is a chair-borne musical instrument support 10 that is both adjustable and portable. The musical instrument support 10 includes a seat portion 20 having a generally planar portion 21, a height-adjustable support arm 30 attached to the seat portion 20, and an instrument rest 32 terminating the top end of the support arm 30. The musician 16 has placed the planar portion 21 of the seat portion 20 on the seat 14 of a chair, and has seated himself on the planar portion 21. The instrument 18 has then been placed on the instrument rest 32, rather than on the musician's lap. FIGS. 1 through 4 show a variety of representative embodiments of the present invention, but in no way serves to exhaust all of the embodiments contemplated by the present invention.

The first embodiment of the present invention is shown in FIG. 1. The first embodiment of the present invention is especially well adapted for children or small adults, since the support arm 30 and the instrument rest 32 may be adjusted to below the chair seat 14 level. This embodiment allows the musician 16 to adjust the level of the instrument 18 upon the instrument rest 32 so that the musician 16 can comfortably play the instrument 18.

The first embodiment includes a seat portion 20 having a downwardly extending portion 22. A mounting plate 36 is attached to the downwardly extending portion 22, and a sleeve 38 is rigidly affixed to the mounting plate 36. The support arm 30 fits through the sleeve 38 and is held in a fixed position within the sleeve by a locking mechanism. The locking mechanism shown in FIG. 1 is a knob 40 which has a threaded screw (not shown) extending therefrom. The threaded screw mates with a threaded hole (not shown) on the sleeve 38, such that when the knob 40 is rotated in the proper direction the screw moves through the hole in the sleeve 38 and contacts the support arm 30. The frictional forces between the screw and the support arm 30 prevent the support arm 30 from sliding through the sleeve 38.

A wide variety of commonly known locking mechanisms may alternatively be used with the present invention. For example, the knob 40 may have a rod (not shown) extending therefrom which extends through a hole (not shown) in the sleeve 38. The knob 40 may be spring biased to push the rod through the hole in the sleeve 38 and into one of a series of holes (not shown) aligned in a row along the length of the support arm 30. The height of the support arm is adjusted by pulling the knob 40 away from the sleeve 38 so that the rod attached to the knob 40 becomes disengaged with the hole on the support arm 30, and sliding the support arm 30 to the desired position and releasing the knob 40, thereby re-engaging the rod and one of the holes. One benefit of using the frictional locking mechanism discussed in the previous paragraph as compared to the spring-biased knob, is that the frictional locking mechanism allows for angular adjustment of the instrument rest 32 about the axis of the support arm 30 if the musician 16 so desires.

As is true with all four of the embodiments of the present invention discussed herein, the seat portion 20 of the first embodiment is made of a thin rigid material which is preferably lightweight for easy transportability. Certain types of conventionally known plastics would serve this purpose well, as would other similar materials. The support arm 30 and instrument rest 32 are also made of a rigid yet lightweight material, such as conventionally known types of plastics or other similar materials. All four embodiments of the present invention may also provide a cushion (not shown) covering the upper surface of the seat portion 20. The cushion would make sitting on the seat portion 20 more comfortable for the musician 16. All four embodiments may also include a non-skid pad or cushion 34 on the upper surface of the instrument rest 32. The pad 34 would not only protect the instrument 18 from scratching or denting by the instrument rest 32, but it would also prevent the base of the instrument 18 from sliding off of the instrument rest 32. The pad 34 can be made of rubber or some other similar material.

The musician 16 uses the instrument support 10 by placing the device 10 in position on the seat 14 of the chair, as shown in FIG. 1, and sitting on the seat portion 20 of the instrument support 10. The support arm 30 and instrument rest 32 extend upward near the front edge of the seat 14 and between the legs of the musician 16. The weight of the musician 16 sitting on the seat 14 holds the instrument support 10 in place. The support arm 30 and instrument rest 32 may then be adjusted vertically up or down to a comfortable height. The base of the instrument 18 is then placed upon the instrument rest 32. The instrument 18 then rests in the same position as if it were being held on the musician's lap without having to be borne by the musician's legs.

Figure 2:
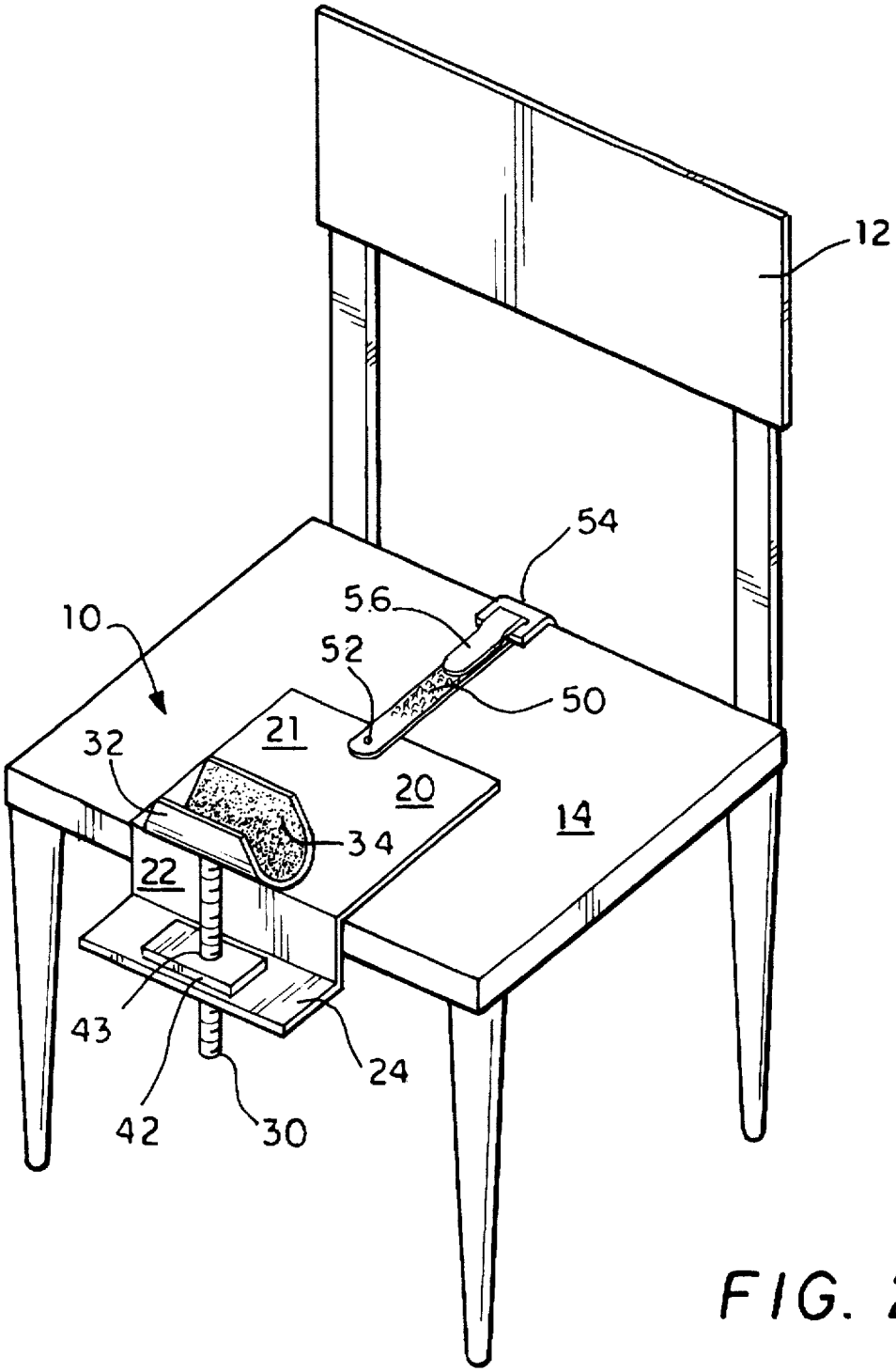
FIG. 2 is an environmental, perspective view of a musical instrument support according to the second embodiment of the present invention including an adjustable strap and hook.

The second embodiment of the present invention is shown in FIG. 2. The second embodiment of the present invention is also especially well adapted for children or small adults, since the support arm 30 and the instrument rest 32 may be adjusted to below the chair seat 14 level. The second embodiment is also shown with one embodiment of an adjustable fastening mechanism which is used to help hold the instrument support 10 on the seat 14 of the chair.

The second embodiment includes a seat portion 20 with both a downwardly extending portion 22 and an outwardly extending portion 24. A mounting plate 42 is rigidly fixed to the outwardly extending portion 24. A threaded hole 43 extends through the mounting plate 42. In the second embodiment the support arm 30 is externally threaded such that the threads on the support arm 30 mate with the threads inside the hole 43. The support arm 30 is then rotated to adjust the height of the instrument rest 32. The instrument rest 32 can be rotatably mounted to the support arm 30 to eliminate the need for rotating the instrument rest 32, and an instrument sitting therein, in order to adjust the height of the instrument rest 32.

Alternatively, several other conventional height adjustment mechanisms can be used with the threaded support arm 30 to achieve similar results to those discussed above. For example, the mounting plate could be replaced by a collar (not shown), which could be rotatably mounted on the outwardly extending portion 24. In this configuration, the height of the instrument rest 32 will be adjusted when the collar is rotated by the musician and the instrument rest 32 is prevented from rotating.

The second embodiment is shown with one embodiment of an adjustable fastening mechanism which is used to help hold the instrument support 10 on the seat 14 of the chair. This embodiment of the fastening mechanism includes a strap 50, a rigid hook 54, and mating hook and loop fasteners 56 on the strap 50. The strap 50 is attached to the seat portion 20 at 52. The strap 50 extends through a slot on the hook 54 and can be overlapped back onto itself such that the hook and loop fasteners mate. Other conventional adjustment mechanisms may be used to achieve similar results. The hook 54 grasps the rear edge of the seat 14 and thereby prevents the instrument support 10 from sliding off the front edge of the seat 14. This embodiment of the fastening mechanism may be used with any of the four embodiments of the instrument support.

Figure 3:
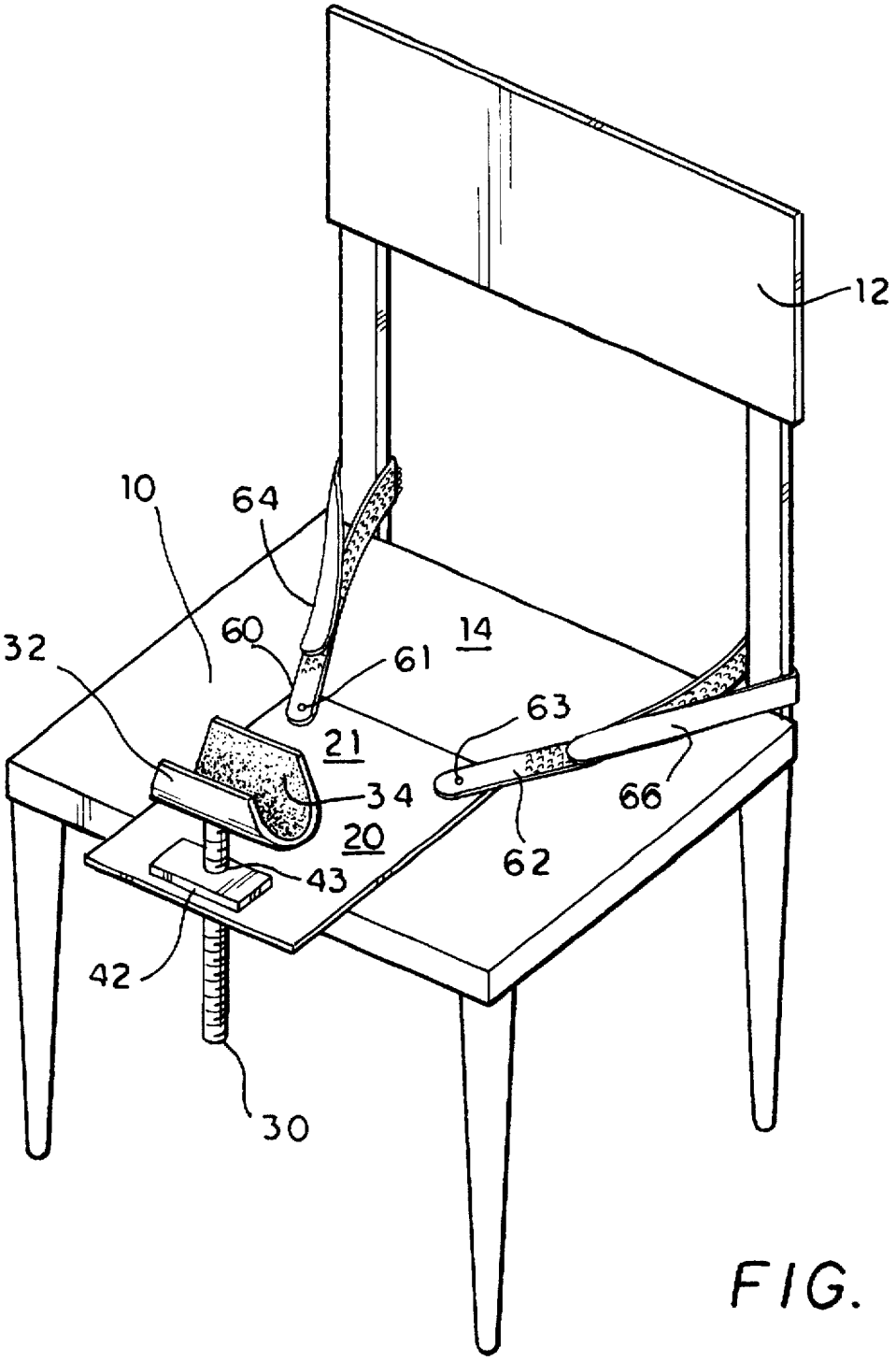
FIG. 3 is an environmental, perspective view of a musical instrument support according to the third embodiment of the present invention including a pair of adjustable straps.

The third embodiment of the present invention is shown in FIG. 3. The third embodiment of the present invention is well adapted for adults or for smaller instruments, since the support arm 30 and the instrument rest 32 may not be adjusted to below the chair seat 14 level. The third embodiment is also shown with a different embodiment of an adjustable fastening mechanism which is used to help hold the instrument support 10 on the seat 14 of the chair.

The third embodiment includes a seat portion 20 that extends outward beyond the front edge of the seat 14. The height adjustment mechanism of the third embodiment is identical to that of the second embodiment, except that the mounting plate 42 is fixed to the seat portion 20.

The third embodiment is shown with a different embodiment of an adjustable fastening mechanism which is used to help hold the instrument support 10 on the seat 14 of the chair. This embodiment of the fastening mechanism includes a pair of straps, 60 and 62, and mating hook and loop fasteners, 64 and 66, on the straps, 60 and 62 respectively. The straps, 60 and 62, are attached to the seat portion 20 at 61 and 63, respectively. The straps, 60 and 62, extend around the supports for the back 12 of the chair and overlap back onto themselves such that the book and loop fasteners mate. Other conventional adjustment mechanisms may be used to achieve similar results. The straps, 60 and 62, grasp the supports for the back 12 of the chair and thereby prevent the instrument support 10 from sliding off the front edge of the seat 14. This embodiment oL the fastening mechanism may be used with any of the four embodiments of the instrument support.

Figure 4:
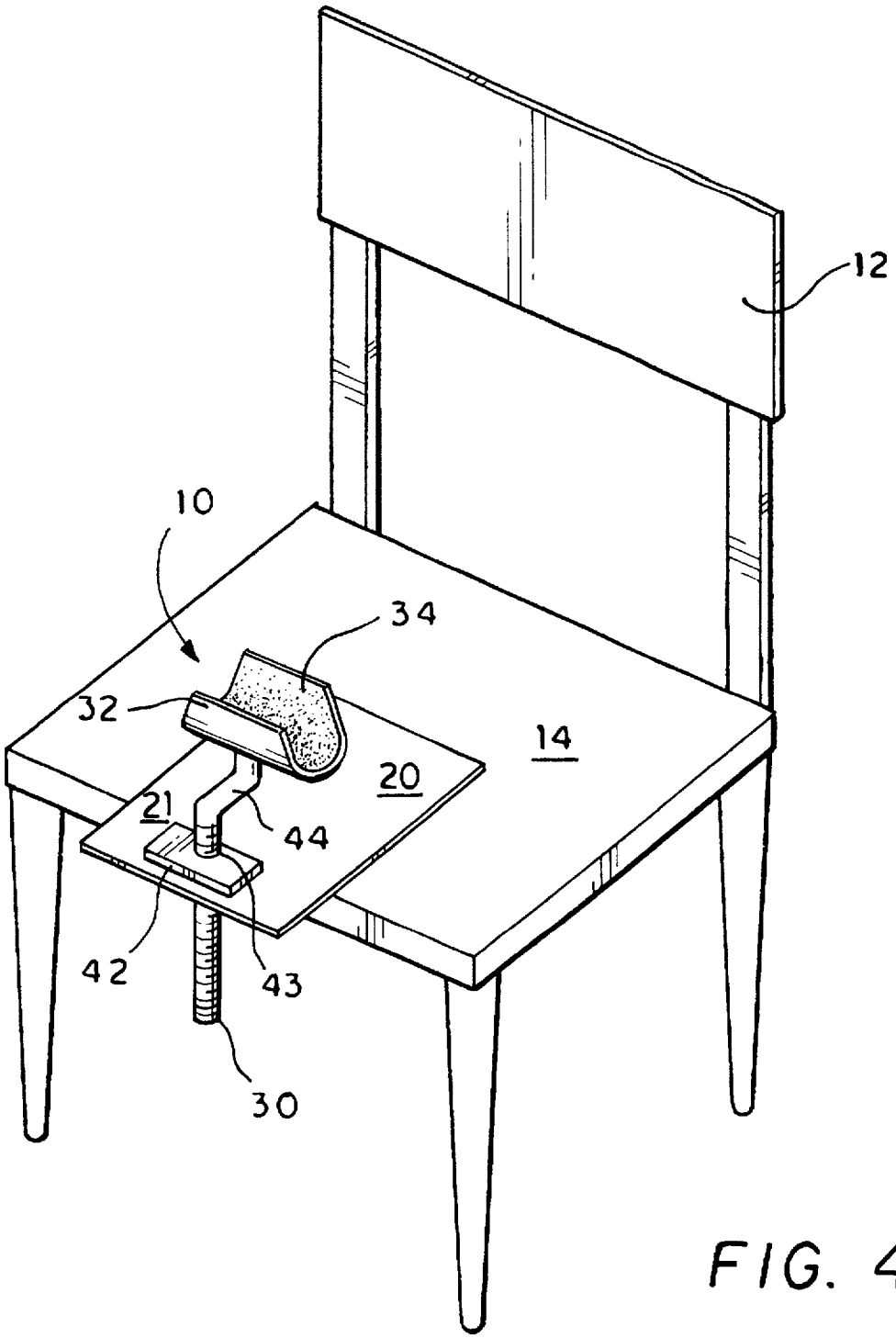
FIG. 4 is an environmental, perspective view of a musical instrument support according to the fourth embodiment of the present invention.

The fourth embodiment of the present invention is shown in FIG. 4. The fourth embodiment of the present invention is well adapted for adults or for smaller instruments, since the support arm 30 and the instrument rest 32 may not be adjusted to below the chair seat 14 level.

The fourth embodiment includes a seat portion 20 that extends outward beyond the front edge of the seat 14 which is identical to that of the third embodiment. The height adjustment mechanism of the fourth embodiment is identical to that of the third embodiment, except that the support arm 30 has a bent portion 44. The bent portion 44 may be oriented to eccentrically position a musical instrument such that the instrument rest 32 is closer to the rear of the seat 14, as shown in FIG. 4, or so that the instrument rest 32 is farther away from the rear of the seat 14. The bent portion 44 allows certain musicians to find a more comfortable playing position then they might otherwise find with the first, second and third embodiments.

It should be noted that in all four of the embodiments of the present invention, the musical instrument support 10 is not permanently attached to the chair, therefore the support 10 may be easily removed and carried with the musician or stored for later use.

It is to be understood that the present invention is not limited to the embodiments described above, but encompasses any and all embodiments within the scope of the following claims.

I claim:

1. A musical instrument support, comprising:

a seat portion having a generally planar portion for placement on a chair seat, said seat portion having a downwardly extending portion, a hollow sleeve mounted on said downwardly extending portion, said sleeve having a threaded hole therethrough, a threaded rod mating with said threaded hole, and said threaded rod having a knob extending therefrom;

a support arm adjustably connected to said seat portion said support arm being slidably received within said sleeve;

a rest attached to said support arm for receiving a musical instrument, said support arm supporting said rest at an adjustable height above said seat portion; and means for holding said seat portion upon the chair seat.

2. The musical instrument support as defined in claim 1, wherein said rest has a non-skid material thereon.

3. The musical instrument support as defined in claim 1, wherein said rest has cushioning thereon.

4. A musical instrument support, comprising:

a seat portion having a generally planar portion for placement on a chair seat, said seat portion having a downwardly extending portion, a hollow sleeve mounted on said downwardly extending portion, said sleeve having a threaded hole therethrough, a threaded rod mating with said threaded hole, and said threaded rod having a knob extending therefrom;

a support arm adjustably connected to said set portion said support arm being slidably received within said sleeve; and a rest attached to said support arm for receiving a musical instrument, said support arm supporting said rest at an adjustable height above said set portion;

whereby when said seat portion is placed onto a seat and a user sits down upon said seat portion, said rest remains positioned at a point above said seat portion.

* * * * *